US007233761B2

(12) United States Patent
Kawagoe

(10) Patent No.: US 7,233,761 B2
(45) Date of Patent: Jun. 19, 2007

(54) METHOD AND APPARATUS FOR TRANSFERRING MULTIPLE TONER IMAGES AND IMAGE FORMING APPARATUS

(75) Inventor: Katsuya Kawagoe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/179,627

(22) Filed: Jul. 13, 2005

(65) Prior Publication Data

US 2007/0014595 A1 Jan. 18, 2007

(51) Int. Cl.
*G03G 15/01* (2006.01)

(52) U.S. Cl. ..... 399/301; 399/167; 399/299; 399/302; 347/116

(58) Field of Classification Search ..... 399/301
See application file for complete search history.

(56) References Cited

U.S. PATENT DOCUMENTS

| | | | | |
|---|---|---|---|---|
| 5,508,789 | A * | 4/1996 | Castelli et al. | 399/8 |
| 6,163,327 | A * | 12/2000 | Mori et al. | 347/115 |
| 7,076,195 | B2 * | 7/2006 | Sakai | 399/301 |
| 2004/0170451 | A1 * | 9/2004 | Iwai | 399/299 |
| 2005/0238388 | A1 * | 10/2005 | Tanaka | 399/167 |
| 2005/0271429 | A1 * | 12/2005 | Tachibana et al. | 399/301 |
| 2006/0203070 | A1 * | 9/2006 | Matsuyama et al. | 347/116 |

FOREIGN PATENT DOCUMENTS

| | | |
|---|---|---|
| JP | 8-10371 | 1/1996 |
| JP | 8-248721 | 9/1996 |
| JP | 10-3048 | 1/1998 |
| JP | 2765626 | 4/1998 |
| JP | 10-138556 | 5/1998 |
| JP | 2002-91264 | 3/2002 |
| JP | 3641085 | 1/2005 |

* cited by examiner

*Primary Examiner*—David M. Gray
*Assistant Examiner*—Bryan Ready
(74) *Attorney, Agent, or Firm*—Oblon, Spivak, McClelland, Maier & Neustadt, P.C.

(57) ABSTRACT

A method of transferring a plurality of toner images formed on a plurality of image carriers of different colors onto a sheet-type recording medium includes forming a mark image for adjusting a transfer position on each of the image carriers as a toner image; transferring the mark images to a common transfer medium; detecting optically a mutual positional relationship between the mark images; and controlling linear velocities of the image carriers based on a result of detecting the mutual positional relationship between the mark images, to transfer the toner images onto the sheet-type recording medium with a reduced misalignment between the toner images.

16 Claims, 5 Drawing Sheets

METHOD AND APPARATUS FOR TRANSFERRING MULTIPLE TONER IMAGES AND IMAGE FORMING APPARATUS

CROSS-REFERENCE TO RELATED APPLICATIONS

The present document incorporates by reference the entire contents of Japanese application number, 2002-365455 filed in Japan on Dec. 17, 2002.

BACKGROUND OF THE INVENTION

1. Field of the Invention

The present invention relates to a method and an apparatus for transferring multiple toner images and an image forming apparatus.

2. Description of the Related Art

Image forming apparatus that uses an optical writing, in which a principle of electrophotography is used, has been known so far as a digital copier, an optical printer, an optical plotter, and a facsimile apparatus etc. In these image forming apparatuses, colorization of an image formed has been advancing and there has been a strong demand for speeding up the image formation. Realization of a so called tandem image forming apparatus that enables color image formation at a speed similar to that of monochrome image formation has been intended.

In the tandem image forming apparatus, an electrostatic latent image is formed by optical writing on a plurality of latent image carriers and each electrostatic latent image is developed by a toner of a different color. A toner image of a different color is formed for each latent image carrier. The plurality of toner images is transferred to a common recording medium in the form of a sheet so that they are superimposed mutually, thereby forming a color image or a multicolor image.

Therefore, in the tandem image forming apparatus, a quality of superimposing on one another the plurality of toner images that are transferred to the same recording medium in the form of a sheet ultimately determines a quality of image that is formed. To superimpose accurately the toner images in this manner, as to how to perform with accuracy a so called registering, i.e. matching mutually front tip portions of the toner images becomes an issue of great importance.

In the tandem image forming apparatus, since an optical system that performs optical writing, the latent image carrier, and a transferring section that transfers the toner image are mutually independent, there are many factors such as an amount of distortion of a lens in the optical system and a distance from a writing position to a transfer position that causes a shift of the toner images. Such a shift of the plurality of toner images is called as misalignment.

Moreover, even if it is presumed that the misalignment could be eliminated by adjusting the apparatus perfectly, change in optical characteristics of a resin lens due to a change in temperature, and an expansion and contraction of the latent image carrier etc. is inevitable, and the misalignment of the toner images occurs due to these factors.

As a method to reduce the misalignment, so far, a mark for registration is written as an electrostatic latent image on each latent image carrier and toner images upon visualizing these electrostatic latent images are transferred to a transfer belt. A mutual positional relationship of the mark images is read optically, and based on a result of optical reading, start-timing of the optical writing has been controlled (see, for example, Japanese Patent Application Laid-open Publication No. H8-248721).

In this case, an optical writing unit that performs deflection of a light beam by a rotating polygon mirror is provided for each latent image carrier. A method of performing with high accuracy the registration by controlling with high accuracy the start-timing of the optical writing for each latent image carrier by controlling a phase of rotation of the rotating polygon mirror corresponding to each latent image carrier, has been proposed (see, for example, Japanese Patent Application Laid-open Publication No. H10-138556). However, since the rotation of the rotating polygon mirror being extremely high-speed rotation, it is not easy to control the phase of rotation and necessitates an expensive controlling unit, thereby leading to a rise in cost.

On the other hand, a tandem image forming apparatus in which the rotating polygon mirror is used commonly for the light beams that perform optical scanning of the plurality of latent image carriers has been proposed (Japanese Patent Application Laid-open Publication No. Hei 10-3048. However, in this case, it is not possible to control by corresponding the phase of rotation of the rotating polygon mirror with each latent image carrier and an effect of decreasing the registration has limitations.

Moreover, a method in which a scale is formed on an intermediate transfer belt or a sheet conveying belt to detect a linear velocity, and based on this linear velocity that is detected by detecting this scale by a scale detecting unit, a rotational drive of the intermediate transfer belt or the sheet conveying belt is controlled, has been known (see, for example, Japanese Patent Application Laid-open Publication No. H8-10371).

SUMMARY OF THE INVENTION

It is an object of the present invention to at least solve the problems in the conventional technology.

A method according to one aspect of the present invention, which is for transferring a plurality of toner images formed on a plurality of image carriers of different colors onto a sheet-type recording medium, includes forming a mark image for adjusting a transfer position on each of the image carriers as a toner image; transferring the mark images to a common transfer medium; detecting optically a mutual positional relationship between the mark images; and controlling linear velocities of the image carriers based on a result of detecting the mutual positional relationship between the mark images, to transfer the toner images onto the sheet-type recording medium with a reduced misalignment between the toner images.

An apparatus according to another aspect of the present invention, which is for transferring a plurality of toner images formed on a plurality of image carriers of different colors onto a sheet-type recording medium, includes a detecting unit that detects optically a mark image for adjusting a transfer position that is optically formed on each of the image carriers, visualized as a toner image, and transferred to a common transfer medium; a control-amount creating unit that creates a control amount to control linear velocities of the image carriers based on a mutual positional relationship between the mark images detected; and a controlling unit that controls rotational drives of the image carriers based on the control amount created. The control-amount creating unit creates the control amount that reduces a misalignment between the toner images transferred.

An image forming apparatus according to still another aspect of the present invention, which forms a multicolor image or a color image, includes an apparatus for transferring a plurality of toner images formed on a plurality of image carriers of different colors onto a sheet-type recording medium. The apparatus includes a detecting unit that detects optically a mark image for adjusting a transfer position that is optically formed on each of the image carriers, visualized as a toner image, and transferred to a common transfer medium; a control-amount creating unit that creates a control amount to control linear velocities of the image carriers based on a mutual positional relationship between the mark images detected; and a controlling unit that controls rotational drives of the image carriers based on the control amount created. The control-amount creating unit creates the control amount that reduces a misalignment between the toner images transferred.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail with reference to the accompanying drawings.

Figure 1A:
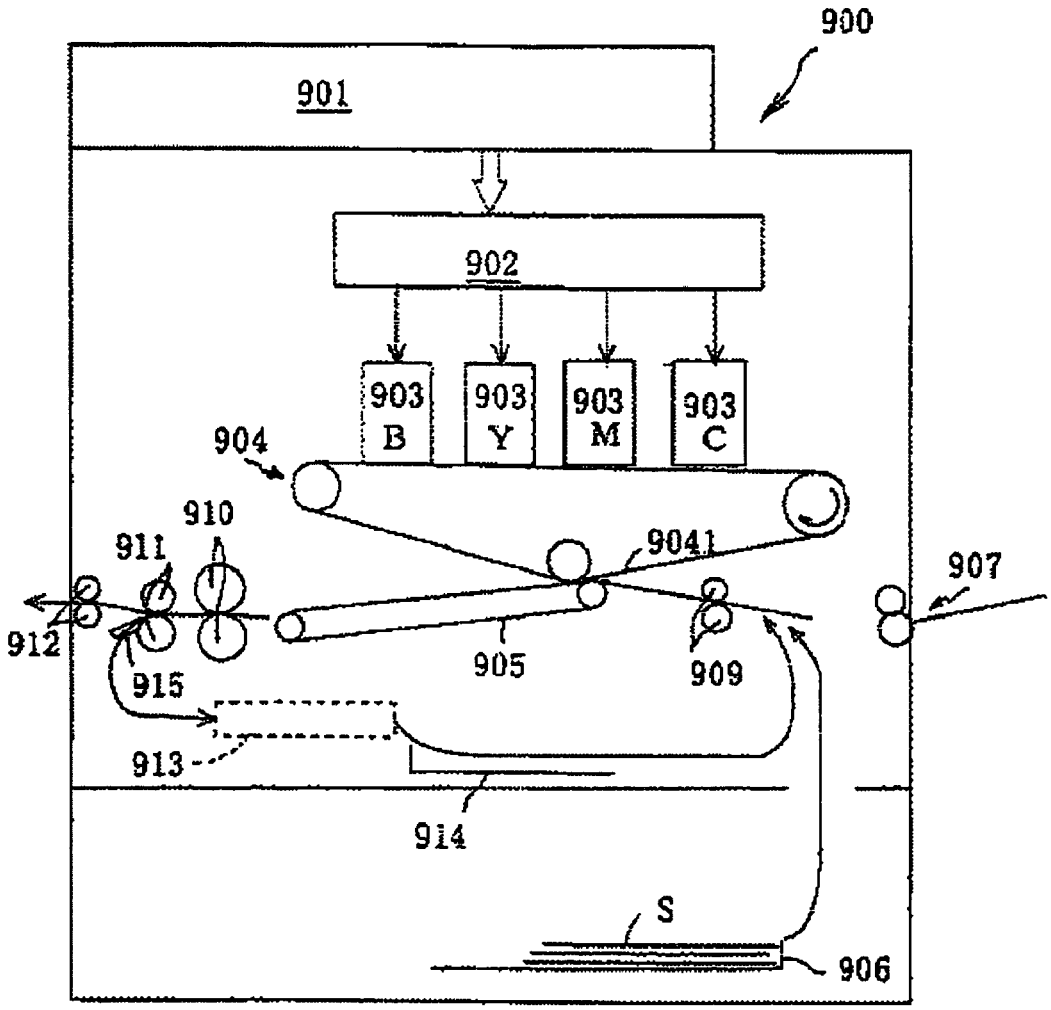
FIGS. 1A and 1B are schematics of an image forming apparatus according to a first embodiment of the present invention.
Figure 1B:
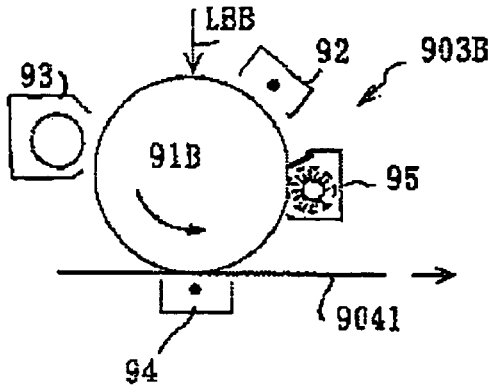

FIGS. 1A and 1B are schematics of an image forming apparatus according to a first embodiment of the present invention. An image forming apparatus 900 shown in FIG. 1A is a tandem color-image forming apparatus. A color document is read in a reading section 901 by color separation into red, green, and blue colors, and based on this information read, and image data corresponding to each of black (B), yellow (Y), magenta (M), and cyan (C) colors is created.

This color data is provided for optical writing in imaging stations 903B, 903Y, 903M, and 903C by an optical writing unit 902. Since the imaging stations 903B, 903Y, 903M, and 903C have an identical structure, description is made with an example of the imaging station 903B.

The imaging station 903B includes a photosensitive drum 91B as a latent image carrier that is driven and rotated in a counterclockwise direction, and a charging charger 92, a developing unit 93, a transfer charger 94, and a cleaning unit 95 that are disposed around the photosensitive drum 91B.

An intermediate transfer belt 9041 in a primary transfer unit 904 runs between the photosensitive drum 91B and the transfer charger 94 as shown in FIG. 1B. The photosensitive drum 91B is charged uniformly by the charging charger 92 that rotates in the counterclockwise direction and B-image data corresponding to a black-color image is written by a laser beam LBB, thereby forming a B latent image. The B latent image is subjected to inverse developing in the developing unit 93 and becomes a B toner image by a black toner. The B toner image is transferred to the intermediate transfer belt 9041 by the transfer charger 94. The photosensitive drum 91 after the transfer of the toner image is cleaned by the cleaning unit 95.

Similarly, toner images for each of Y (yellow), M (magenta), C (cyan) are formed respectively in the image stations 903Y, 903M, and 903C. Each of these Y, M, and C toner images are transferred to the intermediate transfer belt 9041 such that they are superimposed with the B toner image. Thus, a color image by the B, Y, M, and C toner images that are formed on the intermediate transfer belt 9041 is transferred as a color image to a transfer paper S as a recording medium in the form of a sheet.

The transfer paper S is fed from a cassette 906 that is at a lower side of the image forming apparatus or is fed from a bypass paper feeding section 907. The transfer paper S thus fed is carried by a registering roller 909 to a transferring section, i.e. to a contact portion between the intermediate transfer belt 9041 and a secondary transfer belt 905 with a timing matching with the movement of the color image. The color image is transferred to the transfer paper S by an effect of a transfer bias that is applied on the secondary transfer belt 905 by a bias applying unit that is not shown in the diagram. The secondary transfer belt 905 and the bias applying unit that is not shown in the diagram form a secondary transfer unit.

The transfer paper S with the color image transferred on it is carried by the secondary transfer belt 905 and then subjected to decharging by a decharging charger that is not shown in the diagram. The transfer paper S decharged is then separated from the secondary transfer belt 905 and the color image is fixed on the transfer paper S by a fixing unit 910. The transfer paper S with the image fixed on it is then carried by a transporting roller 911 and discharged to an outside of the apparatus by a discharge roller 912.

In a case of a duplex image forming mode of forming an image on both sides of the transfer paper S, a transportation passage of the transfer paper S with a color image fixed on one side is changed by a guiding claw and is carried to an inverting section 913 by the transporting roller 911 and a guide that is not shown in the diagram. In the inverting section 913, the front and the back of the paper are inverted and the transfer paper is stacked in a stacker 914 upon letting a surface with the color image formed on it at the top. The transfer paper S stacked in the stacker 914 is carried once again to a position of the registering roller 909 and a color image is formed similarly on a back surface. After this, the color image on the back side is fixed by the fixing unit 910. The transfer paper S is then carried by the transporting roller 911 and discharged to the outside of the apparatus by the discharge roller 912.

The intermediate transfer belt 9041 includes a substrate of a fluorine based resin that can be stretched a little or a substrate in which a material such as canvas that cannot be stretched easily is provided on a rubber material that can be stretched a lot. An elastic layer formed by a material such as a fluorine-based rubber and an acrylonitrile-butadiene copolymer rubber is provided on this substrate and on a reverse side of it, a fluorine-based resin is coated as a releasing layer. Such a structure can be used for the intermediate transfer belt 9041.

Figure 2A:
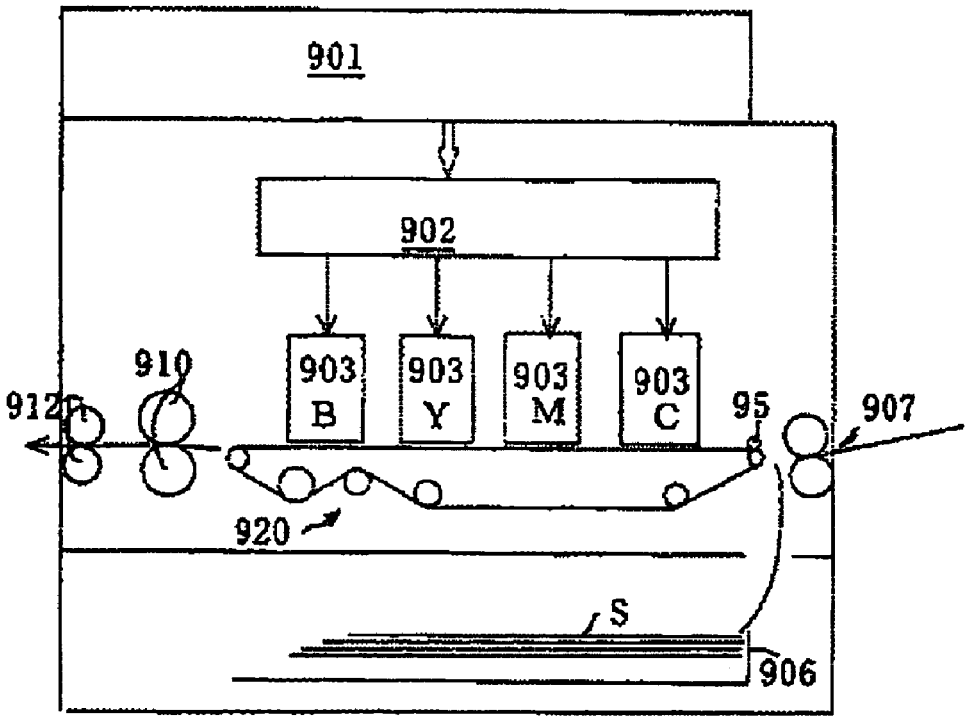
FIGS. 2A and 2B are schematics of an image forming apparatus according to a second embodiment of the present invention.
Figure 2B:
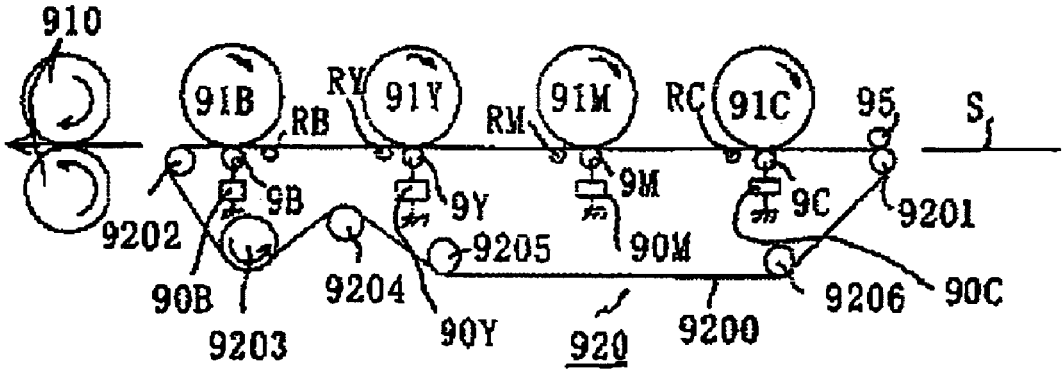

FIGS. 2A and 2B are schematics of an image forming apparatus according to a second embodiment of the present invention. For the sake of explanation, same reference numerals are used as in FIGS. 1A and 1B for components for which there is no possibility of confusion. For the reference numerals identical with those in FIGS. 1A and 1B, the description mentioned above conforming to FIGS. 1A and 1B is to be referred to.

An image forming apparatus shown in FIG. 2A as well, is a tandem color-image forming apparatus. A color document is read in the reading section 901 by color separation into red, green, and blue colors, and based on this information read, and image data corresponding to each of B, Y, M, and C colors is created. This color data is provided for optical writing in the imaging stations 903B, 903Y, 903M, and 903C by the optical writing unit 902.

FIG. 2B is an illustration of structurally important components of a transfer unit 920. As shown in the diagram, an upper surface of a sheet conveying belt 9200 is stretched over the photosensitive drums 91B, 91Y, 91M, and 91C such that it is in contact with bottoms of the photosensitive drums 91B, 91Y, 91M, and 91C. The sheet conveying belt 9200 is stretched over rollers 9201, 9202, 9203, 9205, and 9206, and is driven and rotated in the counterclockwise direction by a drive roller 9203. A roller 9204 is a tension roller and it applies tension required in the sheet conveying belt 9200 as well as widens an angle of contact of the sheet conveying belt 9200 with the drive roller 9203 so that the driving force of the drive roller 9203 is conveyed assuredly to the sheet conveying belt 9200.

On an inner peripheral side of the sheet conveying belt 9200, transfer rollers 9B, 9Y, 9M, and 9C are provided such that they press against the corresponding photosensitive drums 91B, 91Y, 91M, and 91C via the sheet conveying belt 9200. Pressing rollers RB, RY, RM, and RC that are provided near these transfer rollers exert force to press the sheet conveying belt 9200 upward, thereby causing the sheet conveying belt 9200 to form a nip of desired width for each photosensitive drum.

The transfer bias is applied on the transfer rollers 9B, 9Y, 9M, and 9C by bias power supplies 90B, 90Y, 90M, and 90C.

When the toner image is transferred, the transfer paper S that is a recording medium in the form of a sheet is fed by the registering roller that is not shown in the diagram, to the sheet conveying belt 9200.

The transfer paper S that is fed is charged by a charging roller 95 while it is carried by being pressed between the charging roller 95 and the sheet conveying belt 9200. The transfer paper S is carried while being in close contact with an outer peripheral surface of the sheet conveying belt 9200, and a C toner image, an M toner image, a Y toner image, and a B toner image are transferred one by one from the photosensitive drums 91C, 91M, 91Y, and 91B. Because of this transfer, a color image is formed on the transfer paper S.

After transfer of the toner images of these colors, the transfer paper S is decharged by a decharging unit that is not shown in the diagram and then separated from the sheet conveying belt 9200. The transfer sheet S separated is then forwarded to the fixing unit 910 where the abovementioned image is fixed on it by the fixing unit 910, and the transfer paper S is discharged to the outside of the apparatus.

The transfer rollers 9Y, 9M, 9C and the pressing rollers RY, RM, and RC are combined together and can be retracted from a side of the photosensitive drums 91Y, 91M, and 91C by a mechanism that is not shown in the diagram. In an imaging mode of forming a monochrome image with black color, only the transfer roller 9B is let to be operative.

Conversely, in an imaging mode in which the black image is not formed, the transfer rollers 9Y, 9M, and 9C, and the pressing rollers RY, RM, and RC are let to be operative, and the transfer roller 9B and the pressing roller RB are let to be non-operative by retracting from a side of the drum 91B by a mechanism that is not shown in the diagram.

Figure 3A:
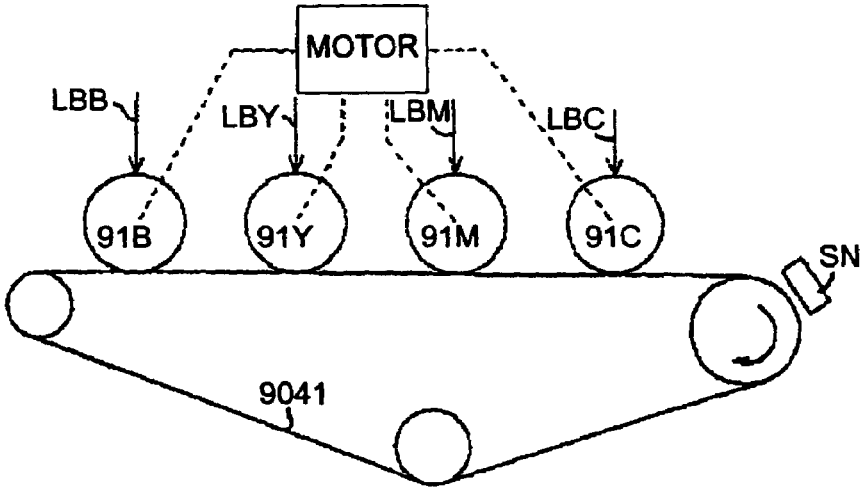
FIGS. 3A, 3B, and 3C are schematics for illustrating an apparatus for transferring multiple-toners according to a third embodiment of the present invention.
Figure 3B:
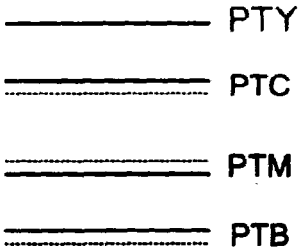
Figure 3C:
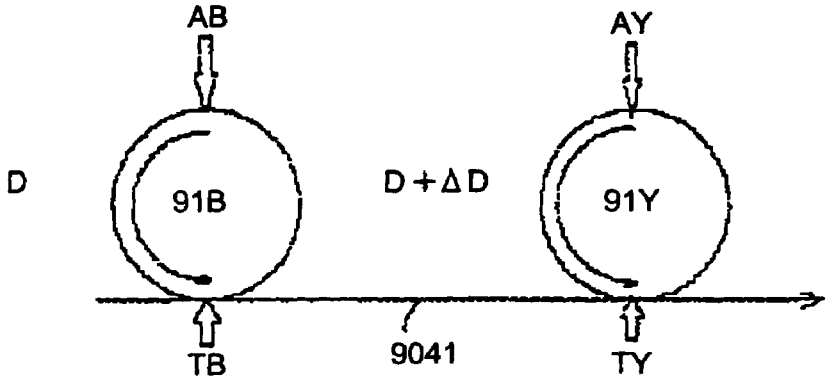

FIGS. 3A, 3B, and 3C are schematics for illustrating an apparatus for transferring multiple-toners according to a third embodiment of the present invention.

According to the third embodiment, the four photosensitive drums 91B, 91Y, 91M, and 91C are driven by a common motor and a gear mechanism that is not shown in the diagram so that the mutual linear velocity of peripheral surfaces is equal.

For registration, as shown in FIG. 3B, mark images PTY, PTC, PTM, and PTB for adjustment of transfer position are formed as toner images (by optical writing and developing) on each of the image carriers 91Y, 91C, 91M, and 91B. These mark images PTY, PTC, PTM, and PTB are transferred to the intermediate transfer belt 9041, which is a common transfer medium, and a mutual positional relationship of the mark images is read and detected optically by a detecting unit SN.

In the mark images PTY, PTC, PTM, and PTB in FIG. 3B, each dashed line mark indicates an ideal position with no shift in the registering position and each continuous line mark indicates a position that is read actually. A plurality of sets of mark lines is formed along a direction of running of the intermediate transfer belt 9401 and is read by a reading unit SN.

The mark image read is processed in a calculating section of a controlling unit, and a time difference between the mark image PTB corresponding to the B toner image and the other mark images PTY-PTB, PTC-PTB, PTB-PTB is calculated. By using these values of mark difference, an average value of shift from the ideal value is calculated.

An amount of shift in the average value that is calculated from a value aimed is reflected in a driving velocity of a motor. Misalignment is reduced by controlling uniformly the linear velocity of each of the photosensitive drums 91B, 91Y, 91M, and 91C by the controlling unit. Thus, there is a misalignment from the average value for each photosensitive drum and misalignment is less than in a case where no correction is applied.

Positions indicated by arrows AB and AY are writing positions for the photosensitive drums 91B and 91Y, positions indicated by arrows TB and TY are positions of transfer of the B toner image and the Y toner image to the intermediate transfer belt 9041.

Let us consider a case where the cause of misalignment is mismatching of a distance from the writing position to the transfer position of the photosensitive drums 91B, 91M, 91C, and 91Y. In other words, let a distance from a writing position AB to the transfer position TB for the photosensitive drum 91B be D and a distance from a writing position AY to the transfer position TY for the photosensitive drum 91Y be $D+\Delta D$.

As a precondition, since the photosensitive drums 91B and 91Y are driven at the same linear velocity, if this linear velocity is let to be V, for the photosensitive drum 91B, time for reaching the B latent image that is written, to the transfer position TB as the B toner image is D/V, and for the photosensitive drum 91Y, time for reaching the Y latent image that is written, to the transfer position TY as the Y toner image is (DΔD)/V, i.e. (D/V)(1ΔD/D).

In this case, there is a misalignment corresponding to a time difference $$(D/V)\cdot(1+\Delta D/D)-(D/V)=(D/V)\cdot(\Delta D/D).$$

In this state, if the linear velocity of the photosensitive drums 91B and 91Y is let to be V+ΔV, for the photosensitive drum 91B, the time for reaching the B latent image that is written, to the transfer position TB as the B toner image becomes D/(V+ΔV) and for the photosensitive drum 91Y, the time for reaching the Y latent image that is written, to the transfer position TY as the Y toner image becomes (D+ΔD)/(V+ΔV).

Since the abovementioned time D/(V+ΔV) is D/{V(1+ΔV/V)}, by expanding the denominator in the bracket and taking up to a primary term, it becomes (D/V)(1−ΔV/V).

Similarly, since the time (D+ΔD)/(V+ΔV) becomes {D(1+ΔD/D)}/{V(1+ΔV/V), this is transformed similarly as mentioned above and the following equation is obtained.

$$(D+\Delta D)/(V+\Delta V)\cong(D/V)(1+\Delta D/D)(1-\Delta V/V)$$

$$=(D/V)\{1+\Delta D/D-\Delta V/V-(\Delta V/V)\cdot(\Delta D/D)\}$$

Therefore, difference with the time (D/V)(1-ΔV/V) becomes $$(D/V)\{\Delta D/D-(\Delta V/V)\cdot(\Delta D/D)=(D/V)(\Delta D/D)\{1-(\Delta V/V)\}.$$

Before changing the linear velocity ΔV, if time corresponding to misalignment is let to be (D/V)·(ΔD/D)=TR, time when only the linear velocity ΔV is changed, becomes TR{1−(ΔV/V). Therefore if ΔV is let to be greater than 0, it is possible to reduce time corresponding to the misalignment and the misalignment as well can be reduced.

In other words, in a method of transferring a plurality of toner images described with reference to FIGS. 3A to 3C, each of the electrostatic images that are formed by optical writing is visualized by a toner of different color for each different latent image carrier to obtain a plurality of toner images of different colors on the plurality of photosensitive drums 91B, 91Y, 91M, and 91C that are driven and rotated. These toner images are superimposed and transferred on the same recording medium in the form of a sheet from each of the latent image carriers. An image forming that forms a multicolor image or a color image, is a method of transferring the plurality of toner images on the recording medium in the form of a sheet, and the mark images PTB, PTY, PTM, and PTC for the adjustment of transfer position are formed on the latent image carriers as toner images. These mark images are transferred to a common transfer belt 9041 and a mutual positional relationship of the mark images is read and detected optically by the detecting unit SN. Based on a result of detection by the detecting unit SN, the linear velocity of the plurality of photosensitive drums 91B, 91Y, 91M, and 91C is controlled by the controlling unit and the toner images are transferred upon reducing the misalignment between the toner images to be transferred (first aspect).

Moreover, by using the intermediate transfer belt 9041 as a common transfer medium, the mark images PTB, PTY, PTM, and PTC for the adjustment of transfer position on each of the latent image carriers are transferred and read and detected optically by the detecting unit SN. The toner images of different colors formed on the plurality of latent image carriers are subjected to primary transfer by transferring to the intermediate transfer belt 9041 and a multicolor image or a color image is obtained on the intermediate transfer belt 9041. The multicolor image or the color image is then subjected to secondary transfer by transferring it from the intermediate transfer belt 9041 to the recording medium S in the form of a sheet according to this method of image transfer (second aspect). Based on a result of detection by the detecting unit SN, the linear velocity of the plurality of photosensitive drums 91B, 91Y, 91M, and 91C is controlled uniformly by the controlling unit according to this method of transferring images (third aspect).

The third embodiment described above can be used as well in a case where the transfer unit that uses the sheet conveying belt 9200 shown in FIGS. 2A and 2B.

In other words, by using the sheet conveying belt 9200 that carries the recording medium S in the form of a sheet, as a common transfer medium, the mark images PTB, PTY, PTM, and PTC for the adjustment of transfer position of each of the photosensitive drums are transferred, and read and detected optically by the detecting unit. The toner images of different colors formed on the plurality of photosensitive drums 91B, 91Y, 91M, and 91C are superimposed and transferred to the recording medium S in the form of a sheet that is attracted by suction and carried by the sheet conveying belt 9200, thereby forming a multicolor image or a color image (third aspect).

Figure 4A:
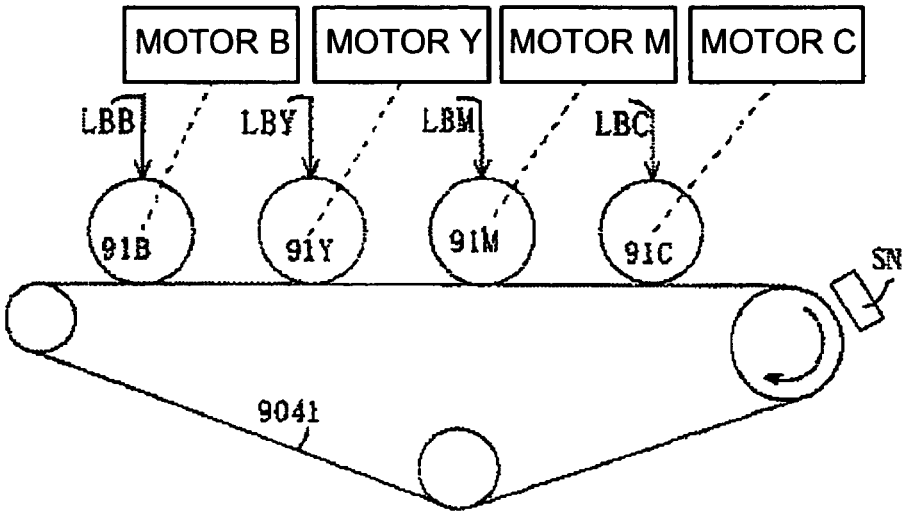
FIGS. 4A and 4B are schematics for illustrating an apparatus for transferring multiple-toners according to a fourth embodiment of the present invention.
Figure 4B:
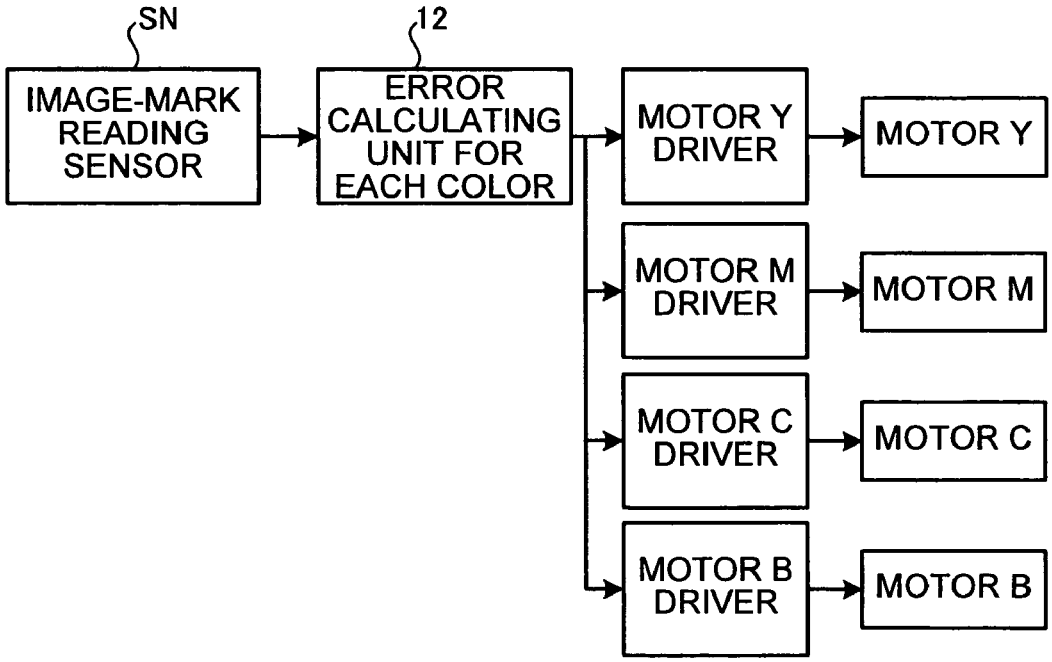

FIGS. 4A and 4B are schematics for illustrating an apparatus for transferring multiple-toners according to a fourth embodiment of the present invention. According to the fourth embodiment, the photosensitive drums 91B, 91Y, 91M, and 91C that are latent image carriers are driven separately by motor B, motor Y, motor M, and motor C respectively.

Same as in the case of the third embodiment, the mark images PTB, PTY, PTM, and PTC are formed (optical writing by the laser beams LBB, LBY, LBM, and LBC, and developing). The mark images formed are transferred to the intermediate transfer belt 9041 as a common transfer medium, and read and detected optically by the detecting unit SM.

As shown in FIG. 4B, information related to the mark images PTB, PTY, PTM, and PTC that is read by the image-mark reading sensor that is a reading unit, and subjected to data processing in an error calculating unit 12 for each color that is a control-amount creating unit.

The error calculating unit 12 for each color functioning as the control-amount creating unit, creates a separate control amount that controls the linear velocity of the photosensitive drums 91B, 91Y, 91M, and 91C, and functioning as a controlling unit controls independently the linear velocity of the plurality of photosensitive drums 91B, 91Y, 91M, and 91C based on the control amount that is created.

In other words, the control amount created is input to a motor Y driver, a motor M driver, a motor C driver, and a motor B driver respectively and the linear velocity of motor Y, motor M, motor C, and motor B is controlled respectively.

The control amount for the linear velocity of each photosensitive drum is created as described below.

Same as in the case of the third embodiment, the mark images PTY, PTC, PTM, and PTB in FIG. 3B are formed and read optically. Difference in reading time between the mark image PTB corresponding to B toner image and other mark images PTY-PTB, PTC-PTB, PTM-PTB is calculated and using this difference in reading time, and an average value of shift from the ideal value is calculated.

If a distance from a writing position to a transfer portion is let to be d, an amount of registration to be adjusted is let to be δ, and a linear velocity before applying the correction is let to be $V_0$, then since time for reaching from the writing position to the transfer portion $T_0=d/V_0$, and an average linear velocity of running distance d+δ in time $T_0$ is $V_A=(d+\delta)V_0/d$, the control amount $V_A-V_0$ can be calculated as $\delta V_0/d$. By controlling the linear velocity by calculating the control amount for each photosensitive drum, an appropriate registration can be realized.

Thus, the information of the mark image read by the mark image reading sensor is transmitted to each color-error detecting unit and a shift from the ideal value of the difference in reading time PTY-PTB, PTC-PTB, and PTM-PTB is calculated. The amount of shift δ is substituted in the equation $V_A=(d+\delta)V_0/d$, and the average velocity VA is calculated for each latent image carrier. By inputting the average velocity to the motor Y driver, motor C driver, motor M driver, and motor B driver, the motor B, motor Y, motor M, and motor C that drive the photosensitive drums 91B, 91Y, 91M, and 91C respectively can be operated at a target velocity.

Similarly, in a case where the transfer unit 920 that uses the sheet conveying belt 9200 shown in FIGS. 2A and 2B instead of the intermediate transfer belt 9041, the appropriate registration can be performed.

According to the embodiments described above, when the linear velocity of the photosensitive drum is changed, a relative velocity is developed between the intermediate transfer belt or the sheet conveying belt, and the photosensitive drum. However, this does not lead to a change in magnification of the image due to the change in the linear velocity of the photosensitive drum.

Such change in magnification does not occur as long as the linear velocity of the intermediate transfer belt or the sheet conveying belt is not influenced by the photosensitive drum. This is because, as the linear velocity increases, a phenomenon in which the image is stretched in a portion exposed to light and is contracted in the transfer portion occurs and there is no change in the magnification of the image on the intermediate transfer belt.

However, if the relative velocity of the linear velocity of the photosensitive drum and the linear velocity of the intermediate transfer belt or the sheet conveying belt increases, while the toner image is transferred from the photosensitive drum to the intermediate transfer belt or the sheet conveying belt, it results in irregularities in the toner image. Therefore, it is desirable that the relative velocity of both the photosensitive drum and the intermediate transfer belt or the sheet conveying belt is as small as possible.

According to the description so far, an optical scanning unit that performs image writing in each imaging station has not been described. For executing the embodiments described above, a suitable optical scanning unit that is known to be associated with the tandem image forming apparatus can be used. For example, an independent optical scanning unit (generally formed by an image forming optical system that includes a light source, an optical deflector, and an fθ lens) may be provided for each imaging station.

Moreover, the optical scanning unit in which light beam that performs optical scanning of the plurality of latent image carriers is deflected by a common rotating polygon mirror can be used.

Figure 5A:
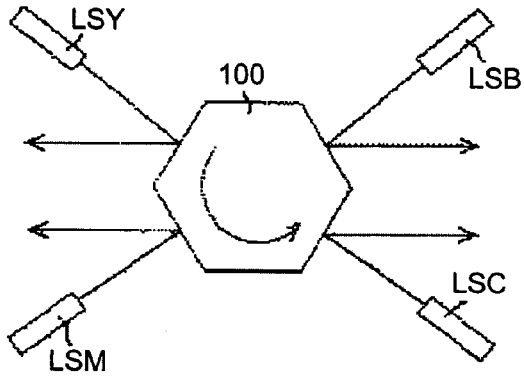
FIGS. 5A, 5B, and 5C are schematics for illustrating an apparatus for transferring multiple-toners according to a fifth embodiment of the present invention.
Figure 5B:
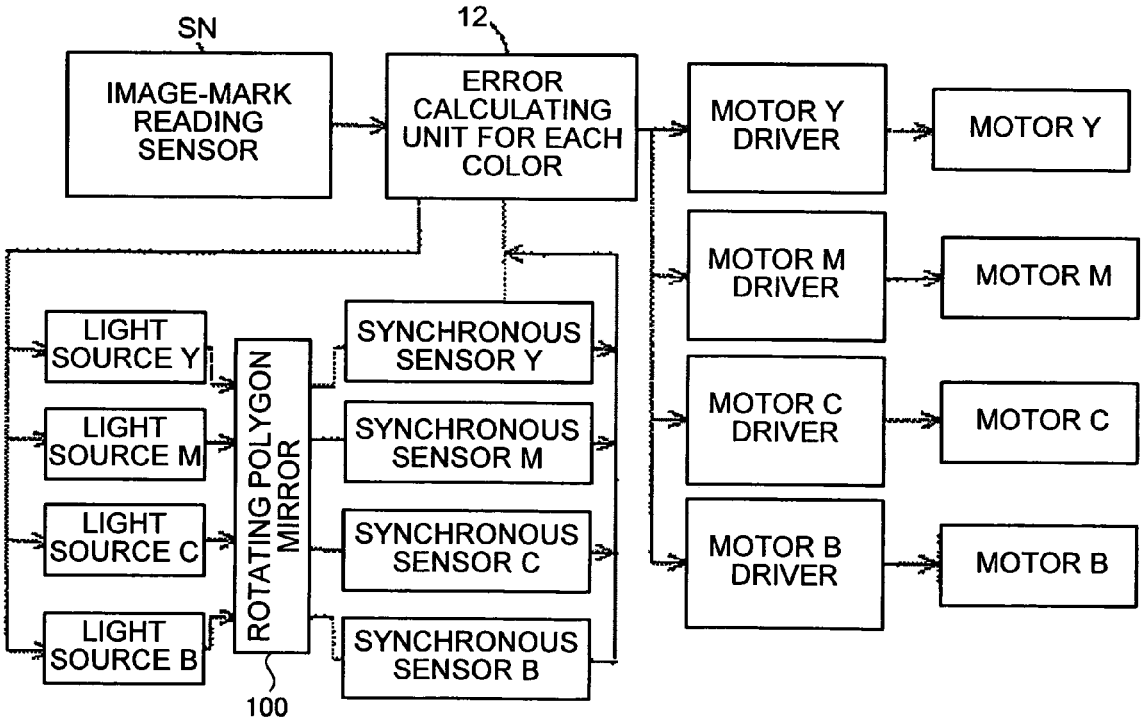
Figure 5C:
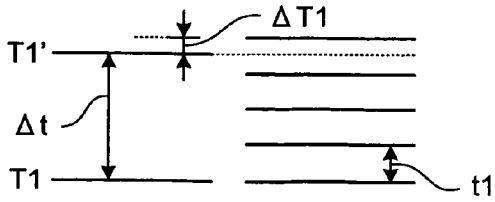

FIGS. 5A, 5B, and 5C are schematics for illustrating an apparatus for transferring multiple-toners according to a fifth embodiment of the present invention. Light beams from light sources LSB, LSY, LSM, and LSC that irradiate light beams for writing black (B) image, yellow (Y) image, magenta (M) image, and cyan (C) image are reflected by a common rotating polygon mirror 100 as shown in the diagram. Due to deflected beams that are deflected together with the rotation of the rotating polygon mirror 100, pass through respective fθ lens that is not shown in the diagram and is directed to the corresponding latent image carriers to perform the writing.

One line (in a single-beam scanning) or multiple lines (in a multi-beam scanning) are written at a deflecting reflector surface of one surface of the rotating polygon mirror 100. Deflected light beam headed for each latent image carrier is detected by separate synchronous sensors Y, synchronous sensor M, synchronous sensor C, and synchronous sensor B (FIG. 5B) respectively and start of writing is synchronized based on detection signal from the synchronous sensors.

In this scanning method, for registration even for starting the writing from half way during the rotation of the deflecting reflector surface, it is necessary to wait for the next deflecting reflector surface and a shift in the reflecting time of the rotating polygon mirror while waiting for the subsequent deflecting reflector surface occurs as misalignment. Since the rotating polygon mirror 100 rotates continuously and the optical scanning of each electrostatic latent image is performed simultaneously, the misalignment of toner image of each color cannot be corrected by a phase adjustment of the rotation of the rotating polygon mirror 100.

According to the fifth embodiment, the optical scanning of each latent image carrier is performed by the multi-beam scanning and writing density is assumed to be 600 dpi. In this case, since size of one dot is 25.4 mm (1 inch)/600=0.0423 and two lines are scanned optically at the one deflecting reflector surface, a distance in a secondary scanning direction that is written by performing optical scanning once is 0.0423×2=0.0846 mm. In other words, shift in time of rotation for one defecting reflector surface is 0.846 mm.

A level of misalignment that can be checked visually is generally considered 0.03 mm, and misalignment of 0.846 mm, which is a shift in the time of rotation, is a size that can be clearly checked visually.

According to the fifth embodiment, the shift in the time of rotation of the rotating polygon mirror is taken into consideration, and the correction of misalignment is performed. For the transfer of the toner image, a case in which the intermediate transfer belt is used, is assumed. However, the following description can be applied as it is, to a case in which the sheet conveying belt is used.

Similarly as in the embodiments described so far, the information of the mark image that is read by the image reading sensor SN is transmitted to the error calculating unit 12 for each color. A shift in the difference in reading time PTY-PTB, PTC-PTB, and PTM-PTB from the target time difference is calculated. The shift δ of toner image of each color is converted into time Δt. A natural number N is obtained by calculation in the error calculating unit 12 for each color such that for each color |Δt−N−time for rotation for one deflecting reflector surface| becomes the minimum.

Referring to FIG. 5C, time t1 is a time for changing the deflecting reflector surface by rotation of the rotating polygon mirror 100. In this case, the minimum of |Δt−N×time for rotation for one deflecting reflector surface| corresponds to the natural number N=4.

In this case, time of writing is shifted from T1 to T1' in the diagram and at the same time an amount of error Δt1 that is a surplus time is corrected by controlling the linear velocity of the latent image carrier. In other words, in the error calculating unit 12 for each color, the control amount (amount of correction of the linear velocity) corresponding to the error amount Δt1 is calculated for each latent image carrier and the motor Y, the motor M, the motor C, and the motor B are controlled via the motor Y driver, the motor M driver, the motor C driver, and the motor B driver.

In other words, when a shift in the difference in reading time PTY-PTB, PTC-PTB, and PTM-PTB and the target time difference is calculated, the error calculating unit 12 for each color causes a light source Y, a light source M, a light source C, and a light source B to emit light, fetches signals from the synchronous sensor Y, the synchronous sensor M, the synchronous sensor C, and the synchronous sensor B, and calculates the natural number N for which |Δt−N×time for rotation for one deflecting reflector surface| becomes the minimum. Based on the number N that is obtained, the timing of emission of light from the light source Y, the light source M, the light source C, and the light source B is corrected such that only time t1 that is necessary for changing N×one deflecting reflector surface is shifted and the surplus time ΔT1 is corrected by controlling the linear velocity of the latent image carrier described above.

By performing such control for each photosensitive drum, it is possible to correct appropriately the misalignment and to transfer the plurality of toner images.

In this method of transferring plurality of toner images, since the correction of a large part of misalignment is performed by correcting the writing timing, and the correction of the rest of the part is performed by controlling the linear velocity of the latent image carrier, a change in the linear velocity with the correction ΔV is small. Therefore, the relative velocity between the intermediate transfer belt or the sheet conveying belt and the latent image carrier does not become high, which enables to prevent an image defect caused by an extreme variation in the relative velocity. In other words, a margin for the variation in the relative velocity of the latent image carrier and the intermediate transfer belt or the sheet conveying belt becomes bigger.

If the relative velocity of the latent image carrier and the intermediate transfer belt is extremely high, there is an overload on a drive of the intermediate transfer belt and the latent image carrier, a rise in a torque, and a slack or stretching of the belt, which can be prevented effectively.

A scale for detecting the linear velocity is formed on the intermediate transfer belt or the sheet conveying belt. This scale is detected by a scale detecting unit. Based on the linear velocity read, controlling the rotational drive of the sheet conveying belt by a belt-drive controlling unit has been known so far (Japanese Patent Application Laid-open Publication No. Hei 8-10371). According to the embodiments described above, in a case where the linear velocity of the intermediate transfer belt or the sheet conveying belt can be controlled, the belt rotational drive controlling unit can be a controlling unit (such as a micro computer) that controls the entire image forming apparatus.

In a case of using the sheet conveying belt, there are many factor of variation such as a surface condition of a transfer paper, firmness, and in many cases, the movement is unpredictable. Therefore, since it is necessary to eliminate completely fluctuation factors such as position shift and magnification error, the method of transferring plurality of toner images according to the present invention is effective.

According to the fourth and the fifth embodiments, the linear velocity of the four photosensitive drums 91B, 91Y, 91M, and 91C is controlled independently. However, in a color image, misalignment between the black toner image and the toner image of other color is the most remarkable, and the misalignment between any colors (Y, M, and C) other than black is not remarkable.

Therefore in such case, instead of controlling the linear velocity of the four photosensitive drums independently, a linear velocity of at least one (that forms a black toner image) of the plurality of photosensitive drums may be controlled independently from that of other photosensitive drums by the controlling unit (fifth, fourteenth, and seventeenth aspect).

According to the fourth and the fifth embodiments, electrostatic latent images formed on the plurality of photosensitive drums 91B, 91Y, 91M, and 91C that are driven and rotated are visualized by toners of different colors for different photosensitive drums, and a plurality of toner images is obtained. This plurality of toner images is superimposed and transferred from the photosensitive drums to the recording medium S in the form of a sheet, and a multicolor image or a color image is formed. An image forming in which such a multicolor image or a color image is formed, includes a method of transferring the plurality of toner images on the recording medium in the form of a sheet, and a mark image for the adjustment of transfer position is formed on each photosensitive drum as a toner image. These mark images PTB, PTY, PTM, and PTC are transferred to a common transfer medium (intermediate transfer belt 9041) and a mutual positional relationship of the mark images is read and detected optically by the detecting unit SN. Based on the result of detection by the detecting unit SN, linear velocity of the plurality of photosensitive drums is controlled by the controlling unit (error calculating unit 12), thereby executing a method of transferring plurality of toner image by transferring upon reducing the misalignment between toner images that are transferred (first aspect).

Moreover, by using the intermediate transfer belt 9041 as a common transfer medium, the mark image for the adjustment of transfer position on each photosensitive drum is transferred, and read and detected optically by the detecting unit SN. The toner images of different colors formed on the plurality of photosensitive drums are subjected to the primary transfer to the intermediate transfer belt 9041 and a multicolor image or a color image is obtained on the intermediate transfer belt 9041. The multicolor image or the color image is subjected to secondary transfer from the intermediate transfer belt 9041 to the recording medium S in the form of a sheet (second aspect).

According to these embodiments, instead of the intermediate transfer belt 9041, by using the sheet conveying belt 9200 that carries the recording medium S in the form of a sheet as a common recording medium, the mark images PTB, PTY, PTM, and PTC for the adjustment of transfer position on the photosensitive drums are transferred, and read and detected optically by the detecting unit. The toner images of different colors formed on the plurality of photosensitive drums are superimposed and transferred to the recording medium in the form of a sheet that is attracted by suction and carried by the sheet conveying belt 9200, thereby enabling to form a multi-color image or a color image (third aspect).

According to the fourth and the fifth embodiments, based on the result of detection by the detecting unit SN, the linear velocity of the plurality of photosensitive drums 91B, 91Y, 91M, and 91C, is controlled independently by the controlling unit 12 (sixth aspect). Furthermore, according to the fifth embodiment, the misalignment between the toner images that are transferred is reduced in combination with the control of start timing of optical writing (seventh aspect).

According to the third to the fifth embodiments, as a plurality of toner image transferring unit, each electrostatic latent image formed by optical writing on the plurality of photosensitive drums 91B, 91Y, 91M, and 91C that are driven and rotated are visualized by toners of different colors for different photosensitive drums, and a plurality of toner images is obtained. This plurality of toner images is superimposed and transferred from the photosensitive drums to the recording medium S in the form of a sheet, and a multicolor image or a color image is formed. An image forming in which such a multicolor image or a color image is formed, includes an image transferring unit that transfers the plurality of toner images on the recording medium in the form of a sheet. Image is formed on each photosensitive drum by optical writing and visualized as a toner image. The toner image is transferred to a common transfer medium. The plurality of toner images transferring unit includes the detecting unit that reads and detects optically the mark images PTB, PTY, PTM, and PTC for the adjustment of transfer position, a control-amount creating unit that creates the control amount that controls the linear velocity of the plurality of photosensitive drums based on the mutual positional relationship of the mark images that are detected by the detecting unit, and a controlling unit that controls the rotational drive of the plurality of photosensitive drums based on the control amount that is created by the control-amount creating unit. The control-amount creating unit creates the control amount that reduces misalignment between the toner image transferred (eighth aspect).

Moreover, the plurality of toner images transferring unit includes the primary transfer unit (such as the intermediate transfer belt 9041) and a secondary transfer unit (such as the secondary transfer belt 905). The primary transfer unit has the intermediate transfer belt 9041 as a common transfer medium and transfers the mark images PTB, PTY, PTM, and PTC on the photosensitive drums for the adjustment of transfer position. The primary transfer unit then reads and detects optically these mark images by the detecting unit SN and performs the primary transfer of the toner images of different colors formed on the plurality of photosensitive drums to the intermediate transfer belt to obtain a multicolor image or a color image. The secondary transfer unit performs the secondary transfer of the multicolor image or the color image on the intermediate transfer belt to the recording medium in the form of a sheet (tenth aspect).

Further, the plurality of toner images transferring unit includes the transfer unit (such as transfer unit 920) uses the sheet conveying belt 9200 that carries the recording medium S in the form of a sheet as a common transfer medium instead of the intermediate transfer belt 9041 according to the embodiments mentioned above, and transfers the mark images PTB, PTY, PTM, and PTC for the adjustment of transfer position on the photosensitive drums. The mark images are read and detected optically as well as the toner images of different colors formed on the plurality of photosensitive drum are superimposed and transferred to the recording medium i.e. the sheet conveying belt 9200 that is attracted by suction and carried by the sheet conveying belt 9200. The plurality of toner images transferring unit can be structure in such a manner (eleventh aspect).

Moreover, a scale for detecting the linear velocity is formed on the intermediate transfer belt 9041 or the sheet transfer belt 9200 and this scale is detected by the scale detecting unit. Based on the linear velocity that is detected by detecting the scale, the rotational drive of the intermediate transfer belt 9041 or the sheet conveying belt 9200 can be controlled by an intermediate transfer belt drive controlling unit (eleventh and twelfth aspects).

In the plurality of toner images transferring unit according to the third embodiment, the control-amount creating section creates the control amount that controls uniformly the linear velocity of the photosensitive drums 91B, 91Y, 91M, and 91C based on the mutual positional relationship of the mark images that are detected by the detecting unit SN. The controlling unit controls uniformly the linear velocity of the plurality of photosensitive drums based on the control amount that is created by the control-amount creating unit (thirteenth aspect).

In the plurality of toner images transferring unit according to the fourth and the fifth embodiments, based on the mutual positional relationship of the mark images that are detected by the detecting unit SN, the controlling unit 12 controls the linear velocity of the photosensitive drums 91B, 91Y, 91M, and 91C independently based on the control amount that is created by the control-amount creating unit.

The plurality of toner images transferring unit according to the third to the fifth embodiments, which is used in the image forming apparatus described with reference to FIGS. 1A and 1B, and FIGS. 2A and 2B, forms the electrostatic latent image by optical writing on the plurality of photosensitive drums that are driven and rotated. Each of the electrostatic latent images formed is visualized by a toner of different color for each different photosensitive drum and a plurality of toner images of different colors is obtained. This plurality of toner images is superimposed and transferred from the photosensitive drum to the recording medium S in the form of a sheet. Thus, in the image forming apparatus that forms a multicolor image or a color image, the plurality of toner images transferring unit according to any of aspects eighth to fifteenth can be used as a transferring unit that transfers the plurality of toner images of different colors.

Moreover, in these image forming apparatuses, there are four photosensitive drums, and Y, M, and C toner images apart from a black (B) toner image are formed on these four photosensitive drums 91B, 91Y, 91M, and 91C. In the plurality of toner images transferring unit according to the fourteenth or fifteenth aspect the linear velocity of the photosensitive drum 91B on which the black toner image is formed is controlled independently from the linear velocity of other photosensitive drums (seventeenth aspect). An optical writing unit writes the electrostatic latent image on each photosensitive drum by optical scanning in which the light beam is deflected by a rotating polygon mirror (eighteenth aspect). The image forming apparatus that uses the plurality of toner images according to the fifth embodiment, the rotating polygon mirror 100 that deflects the optical beam is used jointly for deflecting the light beam that scans the plurality of photosensitive drums (nineteenth aspect). The start-timing of optical writing by the optical writing unit that writes the electrostatic latent image on each of the photosensitive drums, can be controlled for each photosensitive drum (twentieth aspect).

As described above, according to the present invention, a new method of transferring plurality of toner images, a plurality of toner images transferring unit, and an image forming apparatus can be realized.

The method of transferring plurality of toner image and the plurality of toner images transferring unit according to the present invention, as described above, enables to prevent or reduce effectively the misalignment between the toner images during transfer. Therefore, the image forming apparatus that uses this plurality of toner images transferring unit enables to achieve a multicolor image or a color image of high quality by preventing or reducing effectively the misalignment.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of transferring a plurality of toner images formed on a plurality of image carriers of different colors onto a sheet-type recording medium, the method comprising:

forming a mark image on each of the image carriers as a toner image;

transferring each of the mark images to a common transfer medium;

detecting optically a positional relationship of the collective mark images relative to one another; and controlling a mutual linear velocity of at least two of the image carriers based on a result of detecting the positional relationship of the collective mark images relative to one another, to transfer the toner images onto the sheet-type recording medium with a reduced misalignment between the toner images.

2. The method according to claim 1, wherein the common transfer medium is an intermediate transfer belt, and the method further comprises a first transferring including transferring the toner images of different colors onto the intermediate transfer belt to obtain a multicolor image or a color image; and a second transferring including transferring the multicolor image or the color image formed on the intermediate transfer belt onto the sheet-type recording medium.

3. The method according to claim 1, wherein the common transfer medium is a sheet conveying belt that conveys the sheet-type recording medium, and the method further comprises superimposing the toner images of different colors onto the sheet-type recording medium that is conveyed by the sheet conveying belt to obtain a multicolor image or a color image.

4. The method according to claim 1, wherein the controlling step includes controlling a linear velocity of at least one image carrier from among the image carriers independently from the mutual linear velocity of at least two of the image carriers based on the result of detecting the positional relationship of the collective mark images relative to one another.

5. The method according to claim 1, wherein a misalignment between the toner images transferred is reduced in combination with a control of a start timing of optical writing.

6. An apparatus for transferring a plurality of toner images formed on a plurality of image carriers of different colors onto a sheet-type recording medium, the apparatus comprising:

a detecting unit that optically detects a mark image optically formed on each of the image carriers, visualized as a toner image, and transferred to a common transfer medium;

a control-amount generating unit that generates a control amount used to control a mutual linear velocity of at least two of the image carriers based on a positional relationship of the collective detected mark images relative to one another; and a controlling unit that controls rotational drives of the image carriers based on the control amount generated, wherein the control-amount generating unit generates the control amount so as to reduce a misalignment between the toner images transferred.

7. The apparatus according to claim 6, wherein the common transfer medium is an intermediate transfer belt, and the apparatus further comprises a first transferring unit that transfers the toner images of different colors onto the intermediate transfer belt to obtain a multicolor image or a color image; and a second transferring unit that transfers the multicolor image or the color image formed on the intermediate transfer belt onto the sheet-type recording medium.

8. The apparatus according to claim 6, wherein the common transfer medium is a sheet conveying belt that conveys the sheet-type recording medium, and the apparatus further comprises a transferring unit that transfers, in a superposing manner, the toner images of different colors onto the sheet-type recording medium that is conveyed by the sheet conveying belt to obtain a multicolor image or a color image.

9. The apparatus according to claim 7, wherein the intermediate transfer belt includes a scale utilized in detecting a linear velocity of the intermediate transfer belt, and the apparatus further comprises a scale detecting unit that detects the scale to detect the linear velocity of the intermediate transfer belt; and an intermediate-transfer-belt controlling unit that controls a rotational drive of the intermediate transfer belt based on the linear velocity of the intermediate transfer belt detected.

10. The apparatus according to claim 8, wherein the sheet conveying belt includes a scale utilized in detecting a linear velocity of the sheet conveying belt, and the apparatus further comprises a scale detecting unit that detects the scale to detect the linear velocity of the sheet conveying belt; and a sheet conveying belt controlling unit that controls a rotational drive of the sheet conveying belt based on the linear velocity of the sheet conveying belt detected.

11. The apparatus according to claim 6, wherein the control-amount generating unit generates a second control amount used to control a linear velocity of at least one image carrier from among the plurality of image carriers independently from the mutual linear velocity of the at least two image carriers, and the controlling unit controls the linear velocity of at least one of the image carriers independently from the mutual linear velocity of the at least two image camers.

12. An image forming apparatus that forms a multicolor image or a color image, the image forming apparatus comprising an apparatus for transferring a plurality of toner images formed on a plurality of image carriers of different colors onto a sheet-type recording medium, wherein the apparatus includes a detecting unit that optically detects a mark image optically formed on each of the image carriers, visualized as a toner image, and transferred to a common transfer medium;

a control-amount generating unit that generates a control amount used to control a mutual linear velocity of at least two of the image carriers based on a positional relationship of the collective detected mark images relative to one another; and a controlling unit that controls rotational drives of the image carriers based on the control amount generated, and the control-amount generating unit generates the control amount so as to reduce a misalignment between the toner images transferred.

13. The image forming apparatus according to claim 12, wherein four image carriers are provided, on which a black toner image and toner images of three different colors are formed, respectively, the control-amount generating unit generates a second control amount used to control a linear velocity of an image carrier on which the black toner image is formed independently from the mutual linear velocity of other image carriers on which the three different colors are formed, and the controlling unit controls the linear velocity of the image carrier on which the black toner image is formed independently from the mutual linear velocity of the other image carriers.

14. The image forming apparatus according to claim 12, further comprising an optical writing unit that writes an electrostatic latent image on each of the image carriers employing an optical scanning by deflecting a light beam using a rotating mirror.

15. The image forming apparatus according to claim 14, wherein the rotating mirror is used commonly for deflecting light beams to optically scan all of the image carners.

16. The image forming apparatus according to claim 14, wherein the optical writing unit controls a start timing of optical writing for each of the image carriers.

* * * * *